US005713345A

United States Patent [19]

Bentsen et al.

[11] Patent Number: 5,713,345

[45] Date of Patent: Feb. 3, 1998

[54] GRATE ELEMENT

[75] Inventors: Bo Bentsen, Valby, Denmark; Michael Robert Massaro, Bethlehem, Pa.

[73] Assignee: F. L. Smidth & Co. A/S, Denmark

[21] Appl. No.: 362,412

[22] PCT Filed: Sep. 24, 1993

[86] PCT No.: PCT/EP93/02600

§ 371 Date: Dec. 27, 1994

§ 102(e) Date: Dec. 27, 1994

[87] PCT Pub. No.: WO94/08192

PCT Pub. Date: Apr. 14, 1994

[30] Foreign Application Priority Data

Oct. 6, 1992 [DK] Denmark ..... 1227/92

[51] Int. Cl.[6] ..... F23H 13/00

[52] U.S. Cl. ..... 126/152 B; 126/163 R

[58] Field of Search ..... 126/152 B, 163 R; 110/289–291, 298–300, 281, 282; 432/78, 77

[56] References Cited

U.S. PATENT DOCUMENTS 4,870,913 10/1989 Schneider ..... 110/299

5,174,747 12/1992 Massaro, Jr. et al. ..... 432/78

FOREIGN PATENT DOCUMENTS 537523 9/1992 European Pat. Off. .

2092726 8/1982 United Kingdom .

*Primary Examiner*—Larry Jones

*Attorney, Agent, or Firm*—Brumbaugh, Graves, Donohue & Raymond

[57] ABSTRACT

A grate element for a grate surface, e.g. in clinker cooler, comprises a top plate which is shaped in the form of a box having a surface which is plane at one end, whereas at the other end it consists of in cross section downwardly curved slats which, between them, form slots. The grate element further comprises a corrugated bottom plate which is provided with longitudinal rows of slots and projections rising into the slots of the top plate, and gas channels which are defined by the underside of the slats of the top plate and the upper side of the bottom plate, and open at the slots in the two plates. Accordingly, the top plate of the grate element is effectively cooled, the pressure loss through the grate element is appropriately large, the grate element is protected against falling-through of material and maintenance work in connection with the replacement of grate elements is facilitated.

5 Claims, 2 Drawing Sheets

GRATE ELEMENT

The invention relates to a grate element, with gas channels, for a grate surface, e.g. in a clinker cooler.

BACKGROUND OF THE INVENTION

1. Field of the Invention

The function of the grate surface of a clinker cooler, which often comprises a large number of grate elements, is partly to convey clinker material through the cooler and partly to allow the cooling gas to penetrate the clinker material for cooling hereof. The cooling gas is traditionally supplied to all the grate elements of the grate surface via one or very few common, underlying chambers. Given that, in most cases, the clinker material is not homogenous with respect to size, the clinker layer on the grate surface will not be distributed in an even and homogeneous manner, and, therefore, the passage of cooling gas through the different areas of the clinker layer will be very uneven, involving risk that so called "red rivers", i.e. sections of insufficiently cooled clinker, will be formed.

2. Description of the Prior Art

In order to resolve this problem, it has been proposed to provide each grate element in the grate surface separately with cooling gas so that the passage of gas through each single grate element can be controlled in a manner ensuring that the gas is evenly distributed across the entire grate surface. It has also been proposed to provide for a significantly greater pressure loss through the grate surface than through the clinker layer whereby it will mainly be the pressure loss through the grate surface which determines the gas distribution across the grate.

Grate elements of the above kind are known i.a. from EP-A-337383 and EP-A-167658, and both these patent applications indicate solutions to the problem of uneven gas distribution by a combination of a higher pressure loss through the grate and a separate gas supply for each grate element.

In EP-A-337383 a grate element is described, the surface of which is provided with at least one trough for receiving and retaining clinker material for the purpose of minimizing the wear on the grate element and to insulate the grate element from the hot clinker material. The construction of the grate element further ensures that the quantity of clinker material which may fall through the grate is reduced to a minimum since the cooling gas is injected into the material via slots in the upper part of the troughs. However, this grate element has the disadvantages that the troughs will always contain a certain amount of retained material hence causing problems in terms of maintenance, and that larger clinker particles may get stuck in the troughs, hence cutting off the gas passage.

In EP-A-167658 is described a grate element with longitudinal lateral brackets, which define the width of the grate, and a plurality of grate bars extending between and transversely to the brackets, hence forming, between them, a plane surface with transverse gas slots. However, the disadvantages of this grate element are that its construction will not ensure a sufficient cooling of the grate surface itself, and that the hot clinker is deposited directly on this surface hence exposing the grate elements to a relatively significant degree of wear. Further, the grate element is not constructed in such a way that it prevents falling-through of clinker material. Another drawback relates to the manner in which the grate elements are mounted, which makes it difficult to replace the individual grate element, partly because the single grate elements consist of two parts which have to be pushed together, and partly because a whole row of grate elements is assembled by means of common, through-going cross bolts.

SUMMARY OF THE INVENTION

It is the object of the invention to provide a grate element which is so constructed that it will ensure a sufficient pressure loss through the grate, a sufficient cooling of the grate surface, and prevent material from falling through the grate, while simultaneously ensuring uncomplicated mounting and replacement of the grate elements.

According to the invention, a grate element, with gas channels, is characterised by a grate surface-defining top plate and an underlying bottom plate, the lower surface of the top plate having a profile substantially complementary to, and being spaced from, the upper surface of the bottom plate to provide the gas channels; the top and bottom plates both being provided with elongate openings, or rows of openings, extending side by side in substantially the same direction, with the openings of one plate laterally offset between those of the other plate, the openings through the bottom plate forming inlets to the gas channels and being situated at a level higher than the openings through the top plate, which form outlets from the gas channels.

It is hence ensured that the cooling gas is led through the grate element in a manner ensuring effective cooling of the top plate, which is that part of the grate element which is exposed to the greatest thermal load. This is due to the fact that the largest pressure loss through the grate element is generated under the top plate, which is in accordance with the Reynolds analogy which states that "a greater pressure loss will result in greater heat transfer and vice versa". Also, the construction of the grate element ensures against falling-through of material in that the gas channels are formed so that a so-called "water trap effect" is achieved, hence preventing falling-through of material, even when the gas supply is interrupted. Further, the fact that the grate is configured with a top plate and a bottom plate facilitates the maintenance work since it will be possible to replace a single damaged grate element without having to remove any of the surrounding grate elements.

In a preferred embodiment of the invention the bottom plate has a corrugated cross section with slots or holes forming the openings positioned in the crests of the corrugations, whereas the top plate comprises in cross section downwardly curved slats which, when the grate element is assembled, cover the openings in the bottom plate, and slots between which form the openings in the top plate.

The cross section of both the top plate and the bottom plate may be corrugated, but other profiles, e.g. trapezoidal, are also conceivable within the scope of the present invention.

In order to obtain an effective gas flow through the grate element, the bottom plate may be provided with projections, such as beads, aligned with the openings of the top plate and rising towards or into these openings.

BRIEF DESCRIPTION OF THE DRAWINGS

The invention will now be described in further detail with reference to the accompanying diagrammatic drawings, wherein.

DESCRIPTION OF THE PREFERRED EMBODIMENTS

Figure 1:
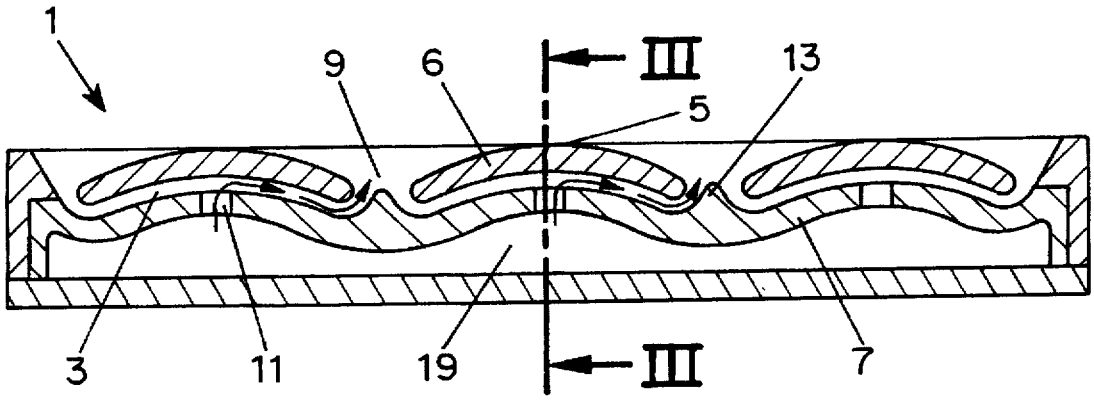
FIG. 1 is a section taken on the line I—I in FIG. 3 a section through a first embodiment of a grate element according to the invention.
Figure 2:
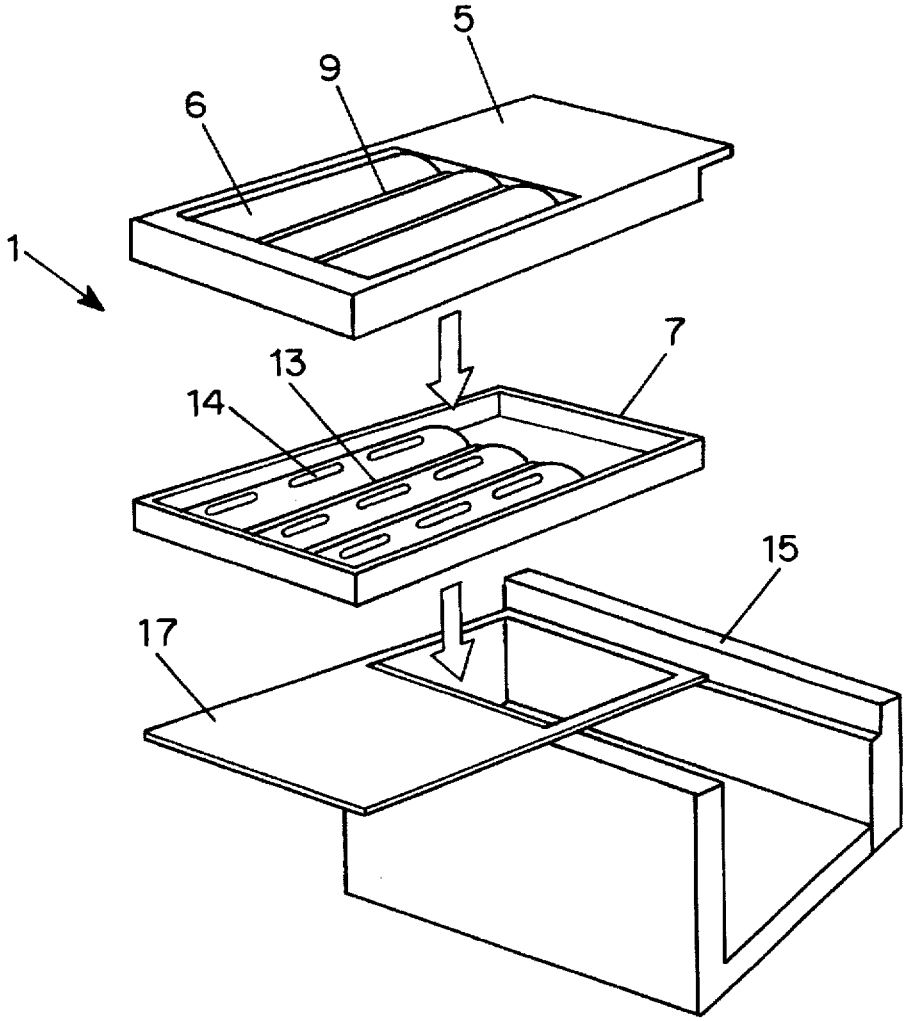
FIG. 2 is an exploded view of the grate element of FIG. 1.
Figure 3:
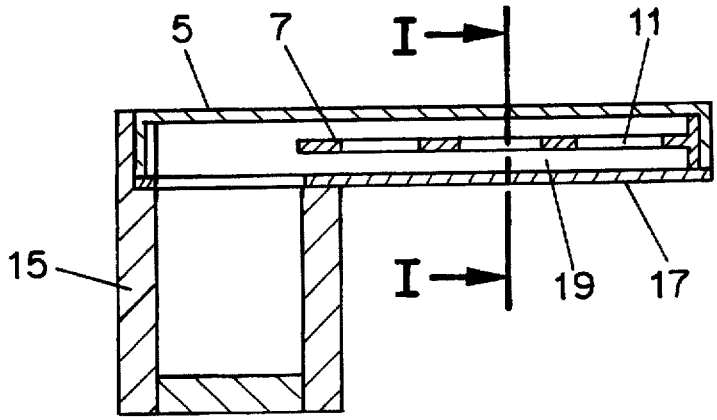
FIG. 3 is a section taken on the line III—III in FIG. 1.

The grate element 1 shown in FIGS. 1 to 3 comprises a top plate 5 which is shaped in the form of a box with a surface which is plane at one end whereas at the other end it consists of downwardly curved, longitudinal slats 6 forming, between them, slots 9. When forming a grate bottom or grate surface, the plane end of the top plate 5 will provide the support for an overlying and overlapping grate element. Further the grate element comprises a corrugated bottom plate 7 which is provided with longitudinal rows of slots 11 and beads 13 rising into the slots 9 between the slats 6. As particularly indicated in FIG. 1, the grate element 1 is provided with gas channels 3, which are defined by the underside of the slats of the top plate 5 and the upper side of the bottom plate 7, and which open at the slots 9, 11 in the two plates 5, 7.

In FIG. 2 is also seen a section of a hollow beam 15 for the supply of cooling gas to the grate element 1 and with a plate element 17 which serves as base and supporting surface for the grate element 1, and forming, together with the bottom plate 7, a gas chamber 19. The plate element 17 may be made as a part of the hollow beam 15.

When utilizing the grate element 1 in a clinker cooler, the cooling gas, usually atmospheric air under pressure, will flow from the beam 15 through the chamber 19 and the gas channels 3 and further up through the clinker material (not shown) which is deposited on top of the grate element 1. On its passage through the gas channels 3, the cooling gas will cool the curved slats 6 of the top plate 5 and owing to the curved path of the channels 3 the cooling gas will incur a certain pressure loss before the gas is directed up through the clinker material by the projections 13.

Because of the peculiar form of the gas channels 3, where the gas inlets 11 are situated at a higher level than the gas outlets 9, the grate element is protected against falling through of clinker material.

Figure 4:
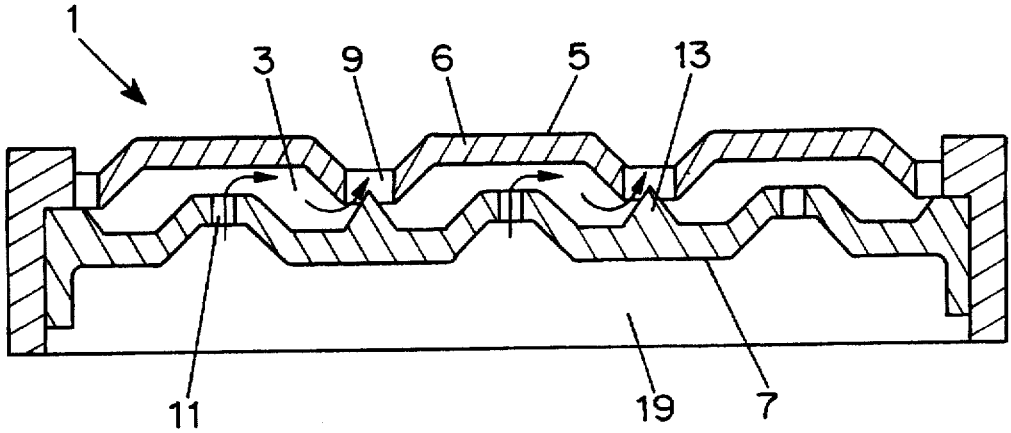
FIG. 4 is a section through a second embodiment of a grate element according to the invention; and, FIG. 5 is a section through a third embodiment of a grate element according to the invention.
Figure 5:
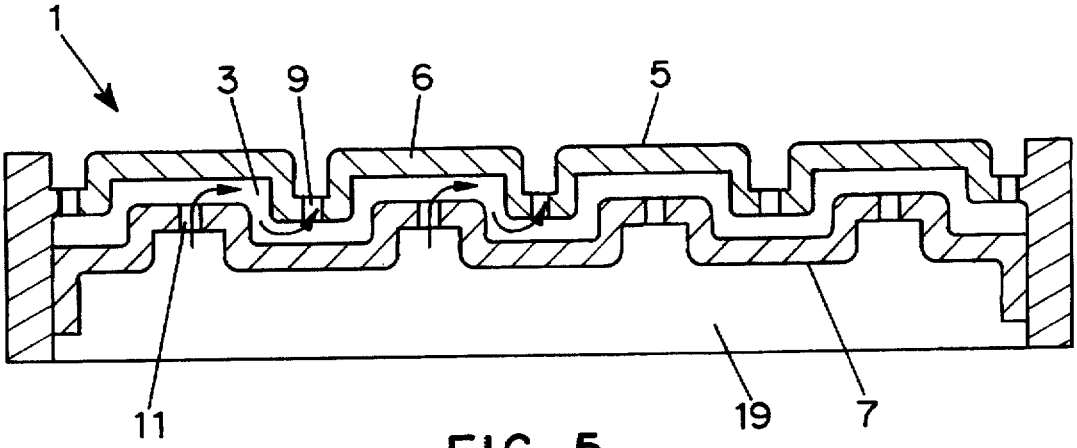

In FIGS. 4 and 5 two alternative embodiments for the grate element 1 are shown. In principle, these function in the same way as the grate element shown in FIGS. 1 to 3, and are provided with the same references as in FIGS. 1 to 3.

We claim:

1. A grate element (1) with gas channels (3); characterised by a grate surface-defining top plate (5) and an underlying bottom plate (7), the lower surface of the top plate having a profile substantially complementary to, and being spaced from, the upper surface of the bottom plate to provide the gas channels (3); the top and bottom plates both being provided with elongate openings (9,11), or rows of openings, extending side by side in substantially the same direction, with the openings of one plate laterally offset between those of the other plate, the openings (11) through the bottom plate forming inlets to the gas channels and being situated at a level higher than the openings (9) through the top plate, which form outlets from the gas channels.

2. A grate element according to claim 1, characterized in that the bottom plate (7) has a corrugated cross section with the openings (11) positioned in the crests of the corrugations, whereas the top plate (5) comprises in cross section downwardly curved slats (6) which, when the grate element (1) is assembled, cover the openings (11) in the bottom plate (7), and slots between which form the openings (9) in the top plate (5).

3. A grate element according to claim 1, characterized in that the cross section of both the top plate and the bottom plate (5, 7) is corrugated.

4. A grate element according to claim 1, characterized in that the cross section of the top plate and the bottom plate (5, 7) is trapezoidal.

5. A grate element (1) according to any one of claims 1 to 4, characterized in that the bottom plate (7) is provided with projections (13) aligned with the openings (9) of the top plate (5) and rising towards these openings.

* * * * *